US010378802B2

(12) United States Patent
Šulc et al.

(10) Patent No.: US 10,378,802 B2
(45) Date of Patent: Aug. 13, 2019

(54) SYSTEM AND METHOD OF TRANSFERRING REFRIGERANT WITH A DISCHARGE PRESSURE

(71) Applicant: THERMO KING CORPORATION, Minneapolis, MN (US)

(72) Inventors: Vladimír Šulc, Minnetonka, MN (US); Pavel Ikráth, Prague (CZ); Panayu Robert Srichai, Minneapolis, MN (US); Srinivasa Rao Koppineedi, Bangalore (IN); Malcom Miles, Ledbury (GB)

(73) Assignee: Thermo King Corporation, Minneapolis, MN (US)

( * ) Notice: Subject to any disclaimer, the term of this patent is extended or adjusted under 35 U.S.C. 154(b) by 364 days.

(21) Appl. No.: 14/915,363

(22) PCT Filed: Aug. 29, 2014

(86) PCT No.: PCT/US2014/053426
§ 371 (c)(1),
(2) Date: Feb. 29, 2016

(87) PCT Pub. No.: WO2015/031766
PCT Pub. Date: Mar. 5, 2015

(65) Prior Publication Data

US 2016/0209093 A1 Jul. 21, 2016

Related U.S. Application Data

(60) Provisional application No. 61/872,228, filed on Aug. 30, 2013.

(51) Int. Cl.
*F25B 13/00* (2006.01)
*F25B 41/04* (2006.01)
(Continued)

(52) U.S. Cl.
CPC ..... *F25B 41/046* (2013.01); *F25B 13/00* (2013.01); *F25B 40/00* (2013.01); *F25B 41/04* (2013.01);
(Continued)

(58) Field of Classification Search
CPC ..... F25B 47/02; F25B 2600/2501; F25B 2400/0403; F25B 2400/0415;
(Continued)

(56) References Cited

U.S. PATENT DOCUMENTS 3,368,364 A 2/1968 Norton et al.
4,197,716 A 4/1980 Nussbaum
(Continued)

FOREIGN PATENT DOCUMENTS

EP 0435535 7/1991

OTHER PUBLICATIONS

International Search Report for International Application No. PCT/US2014/053426, dated Dec. 30, 2014 (3 pages).
(Continued)

*Primary Examiner* — Ana M Vazquez
(74) *Attorney, Agent, or Firm* — Hamre, Schumann, Mueller & Larson, P.C.

(57) ABSTRACT

Systems and methods are described herein to use a discharge pressure of a compressor to drive refrigerant in a refrigeration system. Particularly, systems and methods are described herein to help recover liquid refrigerant from a liquid refrigerant section and/or a condenser coil to be used in a heating/defrost mode in a transport refrigerant unit (TRU). The liquid refrigerant can be recovered by directing the discharge refrigerant of the compressor to a liquid refrigerant section, which may include a receiver tank, a dryer and associated refrigerant lines, and/or a condenser coil. The discharge pressure of the discharge port can help drive
(Continued)

refrigerant trapped in the liquid refrigerant section and/or the condenser coil into the heating/defrost branch of the TRU, which may include an evaporator coil, an accumulator tank and/or associated refrigerant lines.

20 Claims, 5 Drawing Sheets

(51) Int. Cl.
*F25B 49/02* (2006.01)
*F25B 40/00* (2006.01)
*F25B 47/02* (2006.01)

(52) U.S. Cl.
CPC ..... *F25B 47/02* (2013.01); *F25B 47/022* (2013.01); *F25B 49/02* (2013.01); *F25B 2400/0403* (2013.01); *F25B 2400/0411* (2013.01); *F25B 2400/0415* (2013.01); *F25B 2600/2501* (2013.01); *F25B 2600/2515* (2013.01)

(58) Field of Classification Search
CPC ..... F25B 2600/2515; F25B 2400/0411; F25B 49/02; F25B 41/04; F25B 47/022
USPC ..... 62/81
See application file for complete search history.

(56) References Cited

U.S. PATENT DOCUMENTS 4,353,221 A 10/1982 Taylor
4,761,964 A 8/1988 Pacheco
4,932,219 A 6/1990 Howland et al.
4,949,551 A 8/1990 Gregory
5,157,933 A * 10/1992 Brendel ..... F25B 1/10 62/196.4
5,193,353 A 3/1993 Brendel et al.
5,291,941 A * 3/1994 Enomoto ..... B60H 1/00007 165/43
5,319,943 A 6/1994 Bahel et al.
5,400,609 A 3/1995 Sjoholm et al.
5,415,006 A 5/1995 Renken et al.
5,575,158 A 11/1996 Vogel
6,105,375 A 8/2000 Takano et al.
6,279,331 B1 * 8/2001 Hirota ..... B60H 1/00885 62/117
6,560,978 B2 5/2003 Renken
6,609,388 B1 8/2003 Hanson
6,708,510 B2 * 3/2004 Sulc ..... B60H 1/00907 62/151
6,843,065 B2 1/2005 Flynn
6,931,880 B2 8/2005 Aflekt et al.
7,032,395 B2 4/2006 Hanson et al.
2005/0039473 A1 2/2005 Pondicq-Cassou et al.
2005/0081545 A1 4/2005 Gist et al.
2011/0301762 A1 12/2011 Walker et al.
2012/0011866 A1 1/2012 Scarcella et al.
2012/0312036 A1 12/2012 Koppineedi et al.

OTHER PUBLICATIONS

Written Opinion for International Application No. PCT/US2014/053426, dated Dec. 30, 2014 (3 pages).
Supplementary Search Report issued in corresponding European Application No. 14841185.3 dated Oct. 13, 2016. (7 pages).

* cited by examiner

SYSTEM AND METHOD OF TRANSFERRING REFRIGERANT WITH A DISCHARGE PRESSURE

FIELD

The disclosure herein relates to a refrigeration system. More particularly, the disclosure herein relates to a system and method of using a discharge pressure of a compressor to transfer refrigerant in a refrigeration system.

BACKGROUND

Existing TRUs are configured to work with containers, trailers, and other similar transport units to control a temperature inside the transport units. Conventionally, the TRU is generally installed on one side of the transport unit where conditioned air is blown into an internal space of the transport unit. The TRU generally includes a compressor, a condenser coil, an expansion device and an evaporator coil to form a refrigeration circuit. The evaporator coil may be configured to exchange heat with indoor air of, for example, the transport unit to regulate an indoor temperature inside the transport unit.

Some TRUs can work in both cooling and heating/defrost modes. In the cooling mode, refrigerant vapor may be compressed by the compressor, then the compressed refrigerant vapor may be directed into the condenser coil to be condensed into liquid refrigerant. The liquid refrigerant may be expanded by the expansion device to become a liquid/vapor two-phase refrigerant and reduce a temperature of the refrigerant. The two-phase refrigerant may be then directed into the evaporator to exchange heat with air inside, for example, a transport unit. In a heating/defrost mode, the refrigerant vapor compressed by the compressor may be directed into the evaporator coil bypassing the condenser coil and/or the expansion device. The hot refrigerant vapor may exchange heat with the indoor air in the evaporator coil.

SUMMARY

The embodiments disclosed herein relate to a refrigeration system. More particularly, the embodiments disclosed herein relate to a system and method of using a discharge pressure of a compressor to drive refrigerant in a refrigeration system.

In particular, systems and methods are provided that are configured to help recover liquid refrigerant from a liquid refrigerant section and/or a condenser coil in a refrigeration system, such as a TRU, to be used in a heating/defrost mode. The term "a liquid refrigerant section" is generally referred to components of the TRU that are configured to carry liquid refrigerant in the cooling mode, which may include a receiver tank, a dryer and the associated refrigerant lines. The liquid refrigerant section and/or the condenser coil may trap liquid refrigerant when the TRU, for example, starts in a heating/defrost mode or switches from a cooling mode to the heating/defrost mode. The trapped liquid refrigerant may be prevented from being used in the heating/defrost mode, resulting reduction of heating/defrost efficiency.

In general, the embodiments as disclosed herein are configured to use a discharge pressure to drive refrigerant trapped in, for example, a liquid line or condenser coil in a cooling mode, into a heating/defrost branch of the TRU, which may include an evaporator coil, an accumulator tank and associated refrigerant lines, so that the refrigerant in the liquid line or condenser coil in the cooling mode can be recovered and used in the heating/defrost mode.

The systems and methods described herein may be generally configured to perform a refrigerant recovery operation when the heating/defrost mode is activated. In the refrigerant recovery operation, a discharge port of a compressor in the TRU may be connected to at least a portion of the liquid refrigerant section and/or a condenser coil. The discharge refrigerant (and the discharge pressure) from the discharge port of the compressor can help drive the trapped liquid refrigerant out of the liquid refrigerant section and/or the condenser coil into a heating/defrost branch of the TRU, which may include an evaporator coil, an accumulator tank and associated refrigerant lines. These components may carry hot refrigerant vapor in a normal heating/defrost operation of the heating/defrost mode.

In some embodiments, the TRU may include a condenser coil with a condenser inlet and a condenser outlet. The condenser inlet may be connected to the discharge port through a condenser inlet solenoid valve, and the condenser outlet may be equipped with a condenser outlet check valve configured to prevent refrigerant flowing back to the condenser outlet through the condenser outlet check valve. The liquid refrigerant section may be connected to the condenser outlet of the condenser coil. In the cooling mode, refrigerant compressed by the compressor can be condensed into liquid refrigerant in the condenser coil and directed into the liquid refrigerant section through the condenser outlet of the condenser coil.

The TRU may include a bypass line connecting the discharge port to the liquid refrigerant section. The bypass line may include a bypass line solenoid valve. When the TRU performs the refrigerant recovery operation in the heating/defrost mode, the condenser inlet solenoid valve of the condenser coil may be configured to be in a closed state, and the bypass line solenoid valve may be configured to be in an open state so that discharge refrigerant from the discharge port of the compressor can be directed to the liquid refrigerant section through the bypass line, bypassing the condenser coil. The discharge refrigerant from the discharge port of the compressor can help drive liquid refrigerant trapped in the liquid refrigerant section into the heating/defrost branch of the TRU.

In some embodiments, the TRU may include a hot gas line connecting the bypass line to the heating/defrost branch. The hot gas line may include a hot gas line solenoid valve. When the TRU is in the refrigerant recovery operation in the heating/defrost mode, the hot gas line solenoid valve may be configured to be in a closed state so as to generally prevent the discharge refrigerant from flowing into the heating/defrost branch through the hot gas line. When the TRU is in the normal heating/defrost operation in the heating/defrost mode, the hot gas line solenoid valve may be configured to be in an open state to allow the hot discharge refrigerant to flow into the heating/defrost branch.

In some embodiments, the TRU may include a liquid to hot gas line connecting the liquid line to the hot gas line. The liquid to hot gas line may include a liquid to hot gas line solenoid valve. When the TRU is in the refrigerant recovery operation in the heating/defrost mode, the liquid to hot gas line solenoid valve may be configured to be in an open state so as to allow refrigerant to flow from the liquid refrigerant section to the heating/defrost branch, such as an evaporator coil, through the liquid to hot gas line. The liquid to hot gas line solenoid valve may be configured to be in a closed state when the TRU is in a normal heating/defrost operation in the heating/defrost mode. In the refrigerant recovery operation, the liquid to hot gas line may allow the refrigerant to flow from the liquid refrigerant section to the heating/defrost branch without going through the expansion device.

In some embodiments, the TRU may include a liquid to hot gas line check valve configured to prevent refrigerant from flowing from the hot gas line to the liquid line.

In some embodiments, the TRU may include a condenser evacuation line connecting the condenser outlet of the condenser coil to the heating/defrost branch, such as the accumulator tank, of the TRU. The condenser evacuation line may include a condenser evacuation solenoid valve, which may be configured to be in an open state when the TRU is in a condenser evacuation operation of the heating/defrost mode to allow discharge refrigerant to drive refrigerant trapped in the condenser coil into the heating/defrost branch. The condenser evacuation solenoid valve may be configured to be in a closed state when the TRU is in a normal heating/defrost operation of the heating/defrost mode to prevent discharge refrigerant flowing into the condenser coil.

In some embodiments, a method to recover refrigerant for use in a heating/defrost mode may include isolating a condenser coil from a discharge port of a compressor of the TRU. The method may also include isolating a heating/defrost branch of the TRU from the discharge port of the condenser coil and connecting the discharge port of the compressor to a liquid line section of the TRU. When, for example, a predetermined time has reached, the method may proceed to connect the discharge port of the compressor to the heating/defrost branch of the transport refrigeration unit so that the TRU may proceed to the normal heating/defrost operation of the heating/defrost mode.

In some embodiments, the method to recover refrigerant for use in a heating/defrost mode may include a condenser evacuation operation, which may include connecting the discharge port of the compressor to the inlet of the condenser coil and connecting a condenser outlet of the condenser coil to the heating/defrost branch of the TRU. The discharge refrigerant from the discharge port may help drive the liquid refrigerant trapped in the condenser coil to the heating/defrost branch of the TRU in the heating/defrost mode.

Other features and aspects will become apparent by consideration of the following detailed description and accompanying drawings.

DETAILED DESCRIPTION

Figure 1:
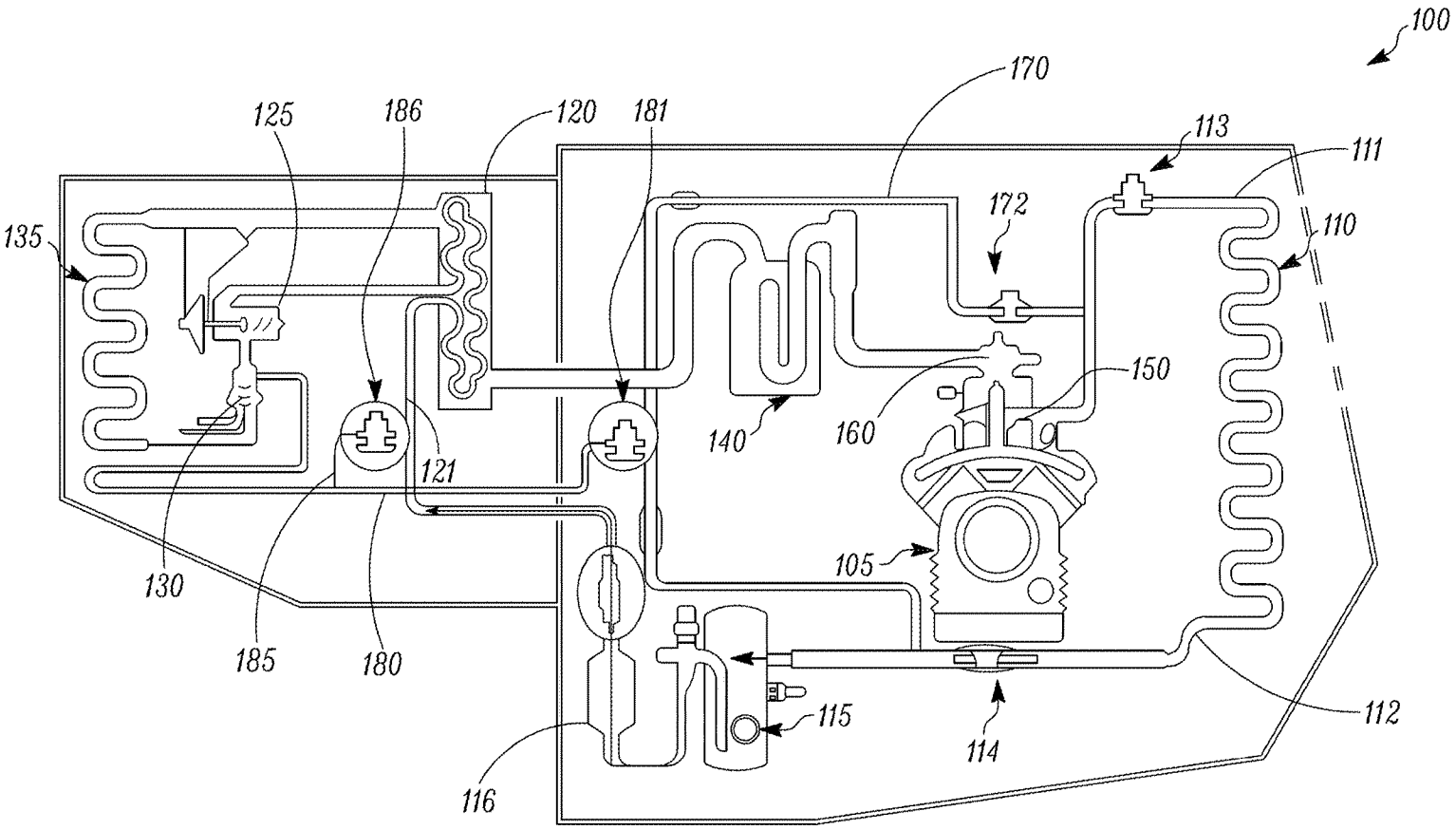
FIG. 1 illustrates a schematic diagram of a TRU according to one embodiment.

A TRU may include a compressor, a condenser coil, an expansion device, an evaporator coil to form a refrigeration circuit. Some TRUs may also include a receiver tank between the condenser coil and the expansion device to, for example, temporarily store liquid refrigerant in a cooling mode. Some TRUs may include an accumulator tank between an outlet of the evaporator coil and an inlet of the compressor to, for example, temporarily store, filter and/or dry the refrigerant.

Some TRUs can work in both a cooling mode and a heating/defrost mode. In the cooling mode, refrigerant vapor can be compressed by the compressor then directed into the condenser coil to be condensed into liquid refrigerant. The liquid refrigerant can be directed into the receiver tank for storage. Components of the TRU that generally carry liquid refrigerant in a cooling mode may be referred to as "a liquid refrigerant section" in this disclosure. The liquid refrigerant may then be directed through the expansion device to expanded into two-phase refrigerant and reduce a temperature of the refrigerant. The two-phase refrigerant can be directed into an evaporator coil to exchange heat with indoor air of for example, a transport unit. The refrigerant flowing out of an outlet of the evaporator coil may be directed into the accumulator tank before being directed back into the compressor.

In the heating/defrost mode, the hot compressed refrigerant may be directed into the evaporator coil, bypassing the liquid refrigerant section, the condenser coil and/or the expansion device. When the TRU starts in the heating/defrost mode or when the TRU switches from the cooling mode to the heating/defrost mode, it is possible that the TRU may not have a sufficient refrigerant charge in a hot gas heating/defrost branch (i.e. the components of the TRU that generally carries hot refrigerant in a heating/defrost mode) of the TRU, which may include the evaporator coil, the accumulator tank and/or associated refrigerant lines. This is because some liquid refrigerant may be trapped in the liquid refrigerant section and/or the condenser coil. An insufficient refrigerant charge condition in the hot gas heating/defrost branch may cause reduction of the heating/defrost capacity. Improvements can be made to help recover refrigerant charge (e.g. liquid refrigerant) from the liquid refrigerant section and/or the condenser coil for use in the heating/defrost mode.

Systems and methods disclosed herein may be generally configured to use a discharge pressure of a compressor to recover refrigerant in a refrigeration system for use, for example, in a heating/defrost mode.

In particular, the systems and methods disclosed herein may be generally configured to utilize the discharge refrigerant of the compressor to drive refrigerant from a liquid refrigerant section, which may include a receiver tank, a dryer and associated refrigerant lines, and/or a condenser coil, into a heating/defrost branch of a TRU, which may include an evaporator coil, an accumulator tank and/or associated refrigerant lines, so that the refrigerant in the liquid refrigerant section and/or the condenser coil can be recovered and used in a heating/defrost mode. When the TRU starts a heating/defrost mode or switches from a cooling mode to the heating/defrost mode, the TRU can be configured to connect a discharge port of a compressor to at least a portion of the liquid refrigerant section and/or the condenser coil. The discharge pressure of the discharge port can help drive refrigerant trapped in the liquid refrigerant section and/or the condenser coil into the heating/defrost branch.

References are made to the accompanying drawings that form a part hereof, and in which is shown by way of illustration of the embodiments in which the embodiments may be practiced. It is to be understood that the terms used herein are for the purpose of describing the figures and embodiments and should not be regarding as limiting the scope of the present application.

FIG. 1 illustrates a TRU 100. The TRU 100 generally includes a compressor 105, a condenser coil 110, a receiver tank 115, a dryer 116, a heat exchanger 120, an expansion device 125, a distributor 130, an evaporator coil 135 and an accumulator tank 140. The compressor 105 includes a discharge port 150 and a suction port 160.

The TRU 100 also generally includes one or more solenoid and/or check valves (i.e. check valve 114 and solenoid valves 113, 186) to direct a refrigerant flow in the TRU 100. The condenser coil 110 has a condenser inlet 111 and a condenser outlet 112. The condenser inlet 111 is equipped with a condenser inlet solenoid valve 113 that can be configured to prevent refrigerant from flowing into the condenser coil 110 through the condenser inlet solenoid valve 113. The condenser outlet 112 is equipped with a condenser outlet check valve 114 that is configured to prevent refrigerant from flowing back to the condenser coil 110 through the condenser outlet check valve 114. The condenser inlet solenoid valve 113 can be configured to allow or block a refrigerant flow toward the condenser coil 110. If the solenoid valve 113 is configured to be in an open state, the refrigerant is allowed to flow from the discharge port 150 into the condenser inlet 111 of the condenser coil 110. If the solenoid valve 113 is configured to be in a closed state, the refrigerant is generally prevented from flowing into the condenser inlet 111 of the condenser coil 110.

The TRU 100 is equipped with a bypass line 170, which is configured to connect the discharge port 150 to a position between the condenser outlet check valve 114 and the receiver tank 115. As illustrated in FIG. 1, the refrigerant can be directed from the discharge port 150 toward the receiver tank 115 without going through the condenser coil 110 via the bypass line 170. The bypass line 170 is equipped with a bypass line solenoid valve 172. The bypass line solenoid valve 172 is located between the discharge port 150 of the compressor 105 and a connecting position of a hot gas line 180 along the bypass line 170. When the bypass line solenoid valve 172 is in an open state, the refrigerant is allowed to flow from the discharge port 150 into the bypass line 170. When the bypass line solenoid valve 172 is in a closed state, the refrigerant is generally prevented from flowing into the bypass line 170.

By opening and/or closing the bypass line solenoid valve 172 and the condenser inlet solenoid valve 113, the refrigerant from the discharge port 150 can be directed into the condenser coil 110 and/or the bypass line 170.

The bypass line 170 is connected to the hot gas line 180, which is configured to direct refrigerant from the bypass line 170 into the evaporator coil 135 through, for example, the distributor 130 as shown in FIG. 1 in a heating/defrost mode. The hot gas line 180 is equipped with a hot gas line solenoid valve 181. When the hot gas line solenoid valve 181 is in an open state, the refrigerant can be directed into the evaporator coil 135 though the hot gas line 180 (e.g. in the heating/defrost mode). When the hot gas line solenoid valve 181 is in a closed state, the refrigerant is generally prevented from flowing into the hot gas line 180.

A liquid to hot gas line 185 is configured to allow refrigerant to flow between a heat exchanger inlet line 121 and the hot gas line 180. The liquid to hot gas line 185 is equipped with a liquid to hot gas line solenoid valve 186. When the liquid to hot gas line solenoid valve 186 is open, the liquid to hot gas line 185 can allow a relatively unrestricted flow between the heat exchanger inlet line 121 and the hot gas line 180. When the liquid to hot gas line solenoid valve 186 is closed, the refrigerant is generally prevented from flowing between the heat exchanger inlet line 121 and the hot gas line 180.

In operation, the TRU 100 can be configured to work in a cooling mode and/or a heating/defrost mode. In the cooling mode, the condenser inlet solenoid valve 113 is open allowing refrigerant to flow into the condenser coil 110. The refrigerant vapor may be compressed by the compressor 105, which increases a temperature of the refrigerant vapor, directed into the condenser coil 110, and then condensed into liquid refrigerant in the condenser coil 110. The liquid refrigerant can flow through the receiver tank 115, the dryer 116 and the heat exchanger 120, and then expanded into two-phase refrigerant through the expansion device 125. The two-phase refrigerant can be distributed into the evaporator coil 135 through the distributor 130 to exchange heat with, for example, indoor air in a transport unit. The refrigerant can then flow through the accumulator tank 140 and return to the compressor 105 via the suction port 160. The term "liquid refrigerant section" may generally include components between the condenser outlet 112 and the expansion device 125, such as the receiver tank 115, the dryer 116 and the associated refrigerant lines. The liquid refrigerant section is configured to generally carry liquid refrigerant in the cooling mode.

In the heating/defrost mode, the condenser inlet solenoid valve 113 is closed, and the bypass line solenoid valve 172 and the hot gas line solenoid valve 181 are open. Refrigerant from the discharge port 150 of the compressor 105 is directed into the evaporator coil 135 through the hot gas line solenoid valve 181 and the distributor 130, generally bypassing the liquid line section in the cooling mode and the condenser coil 110. The refrigerant can exchange heat with, for example the indoor air in a transport unit, in the evaporator coil 135. The refrigerant may then return to the compressor 105 via the suction port 160. The term "heating/defrost branch" may generally include the heat exchanger 120, the evaporator coil 135 and the accumulator tank 140, which generally carry hot refrigerant in the heating/defrost mode.

In the heating/defrost mode, the refrigerant is generally prevented from flowing through the liquid refrigerant section (such as the receiver tank 115 and the dryer 116), and the condenser coil 110. Any liquid refrigerant trapped in the liquid refrigerant section and/or the condenser coil 110 during a cooling mode may remain in the liquid refrigerant section and/or the condenser coil 110 during the heating/defrost mode. This can cause reduction of the heating/defrost capacity. Recovery of the liquid refrigerant trapped in the liquid refrigerant section and/or the condenser coil 110 to use in the heating/defrost mode may help increase the heating/defrost capacity.

To help recover the refrigerant trapped in the liquid refrigerant section, the TRU 100 may enter into a refrigerant recovery operation before a normal heating/defrost operation, for example, for a predetermined time, when the TRU 100 starts in a heating/defrost mode or switch from a cooling mode to a heating/defrost mode. In some embodiments, the predetermined time can be from about 5 seconds to about 5 minutes. In the refrigerant recovery operation, the condenser inlet solenoid valve 113 is closed. Consequently, the refrigerant leaving the discharge port 150 of the compressor 105 is generally prevented from flowing into the condenser coil 110. The bypass line solenoid valve 172 is open while the hot gas solenoid valve 181 is closed, which allows refrigerant from the discharge port 150 to flow into the bypass line 170, and then into at least a portion of the liquid refrigerant section, such as the receiver tank 115, the dryer 116 and the associated refrigerant line.

Because the condenser outlet check valve 114 is configured to prevent refrigerant from flowing into the condenser coil 110 through the condenser outlet check valve 114, the discharge refrigerant from the discharge port 150 is generally prevented from entering the condenser coil 110 through the bypass line 170 and the condenser outlet check valve 114. The discharge refrigerant from the discharge port 150 therefore enters the portion of the liquid refrigerant section and can push the refrigerant in the portion of the liquid refrigerant section toward the heating/defrost branch, which, for example, includes the evaporator coil 135 and the accumulator tank 140.

The liquid to hot gas line solenoid valve 186 is open, which allows the refrigerant out of the liquid refrigerant section to flow into the heating/defrost branch (e.g. the evaporator coil 135) through the refrigerant recover line solenoid valve 186 and the distributor 130. The liquid to hot gas line solenoid valve 186 allows the refrigerant out of the liquid refrigerant section to flow into the heating/defrost branch relatively unrestrictedly without flowing through the heat exchanger 120 and the expansion device 125. This may help speed up the refrigerant recovery process. However, some of the refrigerant out of the liquid refrigerant section may flow into the heating/defrost branch though the heat exchanger 120 and the expansion device 125.

After, for example, a predetermined period of time, the hot gas solenoid valve 181 can be opened to allow refrigerant to flow into the hot gas line 180 so that the TRU 100 may enter the normal heating/defrost operation in the heating/defrost mode. The predetermined period of time may be about a period of time that is required for the refrigerant in the liquid refrigerant section to move to the heating/defrost branch. In some embodiments, the hot gas solenoid valve 181 can remain closed (so that the TRU 100 remains in the refrigerant recovery operation) until a discharge pressure from the discharge port 150 reaches a predetermined pressure.

In general, FIG. 1 provides an embodiment that includes the bypass line 170 configured to direct discharge pressure from the compressor 105 to drive refrigerant trapped in at least a portion of the liquid refrigerant section into the heating/defrost branch. The recovered refrigerant is driven into the heating/defrost branch mainly through the distributor 130.

It is to be noted that the TRU 100 may be configured to have more or less components than as illustrated in FIG. 1. The general principle to recover refrigerant in the liquid refrigerant section is to isolate the condenser coil 110 and the heating/defrost branch of the TRU 100 from the discharge port 150 of the compressor 105 in the refrigerant recovery operation and direct discharge refrigerant from the discharge port 150 of the compressor 105 to at least a portion of the liquid refrigerant section, when the TRU 100 starts in the heating/defrost mode or switch from the cooling mode to the heating/defrost mode. This may allow the discharge refrigerant from the discharge port 150 to drive the refrigerant trapped in the liquid refrigerant section to the heating/defrost branch of the TRU 100. After, for example, a predetermined period of time or the discharge pressure from the discharge port 150 reaches a predetermined pressure, the TRU 100 can be configured to enter the normal heating/defrost operation. The term "isolating" generally means using a refrigerant flow barrier, such as a solenoid valve in a closed state, to prevent refrigerant flowing between two "isolated" components through the refrigerant flow barrier. When isolated from the compressor 105 by the condenser inlet solenoid valve 113, for example, the condenser coil 110 generally does not receive a refrigerant flow from the compressor 105 through the condenser inlet solenoid valve 113.

Figure 2:
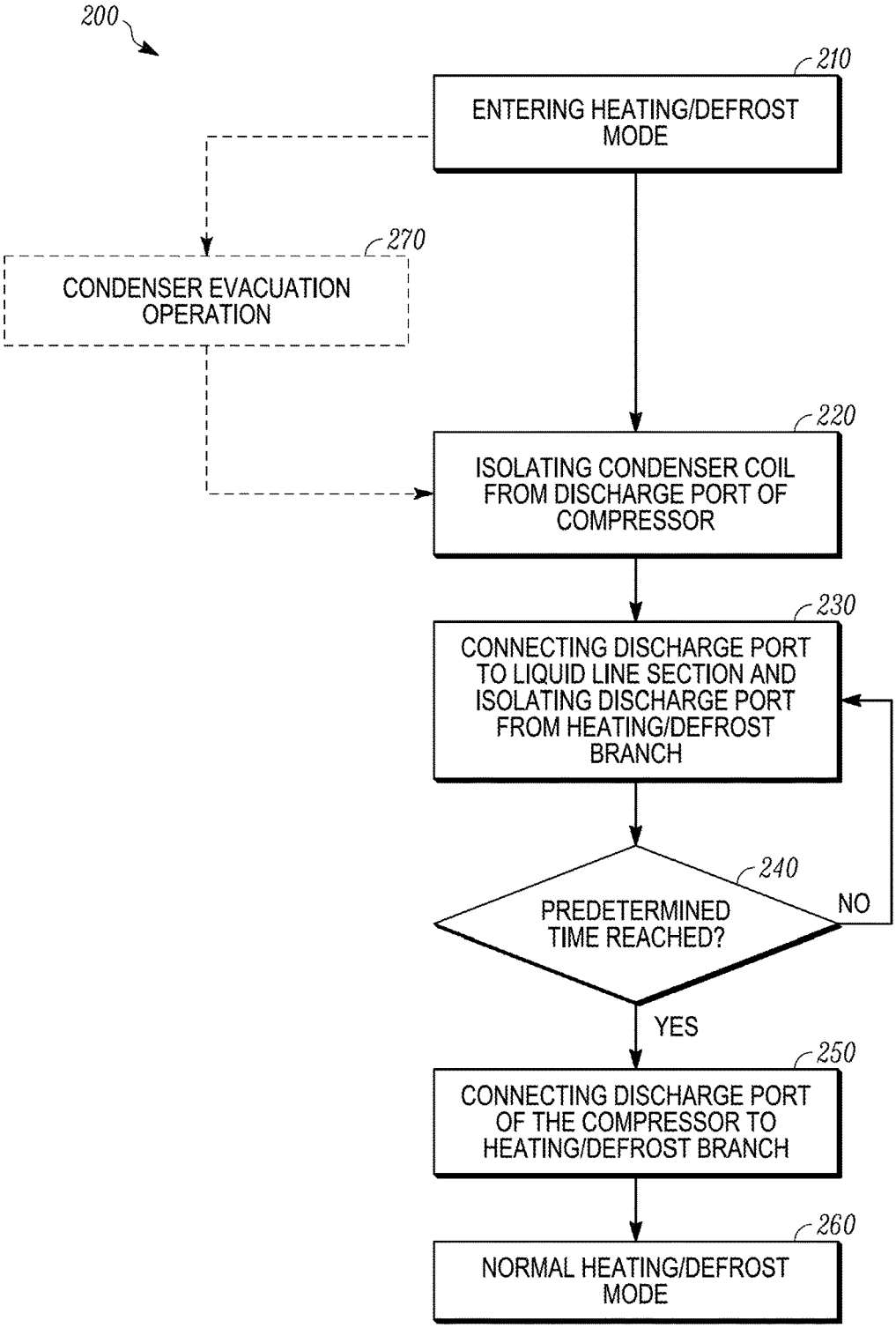
FIG. 2 illustrates a flow chart of a method of refrigerant recovery operation in a heating/defrost mode according to one embodiment.

FIG. 2 illustrates a method 200 of refrigerant recovery operation. The method 200 can be performed, for example, by the TRU 100 as illustrated in FIG. 1. At 210, a TRU is configured to enter a heating/defrost mode. The heating/defrost mode can be activated by starting the TRU in the heating/defrost mode, or switching from a cooling mode to the heating/defrost mode. At 220, a condenser coil (such as the condenser coil 110 of the TRU 100 in FIG. 1) is isolated from a discharge port (such as the discharge port 150 in FIG. 1) of a compressor (such as the compressor 105 in FIG. 1) of the TRU.

At 230, the discharge port of the compressor is isolated from the heating/defrost branch of the TRU. Further, refrigerant is allowed (for example, by opening the solenoid valve 172 in FIG. 1) to flow from the discharge port to at least a portion of a liquid refrigerant section of the TRU, which may include a receiver tank, a dryer and associated refrigerant lines. Because the heating/defrost branch and the condenser coil are isolated from the discharge port of the compressor, the discharge refrigerant from the discharge port may generally flow into the liquid refrigerant section and drive refrigerant in the liquid refrigerant section toward the heating/defrost branch.

When a predetermined time has been reached (or a predetermined discharge pressure has been reached) at 240, the method 200 proceeds to 250 to allow refrigerant to flow from the discharge port of the compressor to the heating/defrost branch (for example, by opening the hot gas line solenoid valve 181 in FIG. 1) so that the refrigerant can flow from the discharge port into the heating/defrost branch without entering the liquid refrigerant section. This allows the TRU to enter a normal heating/defrost operation at 260, which is configured to exchange heat between hot refrigerant in, for example, the evaporator coil with indoor air of a transport unit. If a predetermined time has not been reached at 240, the method 200 returns to 230.

The method 200 can optionally have a condenser evacuation operation 270 configured to recover refrigerant from the condenser coil. A system and a method to perform the condenser evacuation operation is described in FIG. 5.

The method 200 can be performed by other suitable TRU embodiments. Some of the embodiments, by way of example but without limitation, are illustrated, for example, in FIGS. 1, 3, 4 and 5. The method 200 including the optional condenser evacuation operation 270 can be performed by the TRU embodiment as illustrated in FIG. 5.

Figure 3:
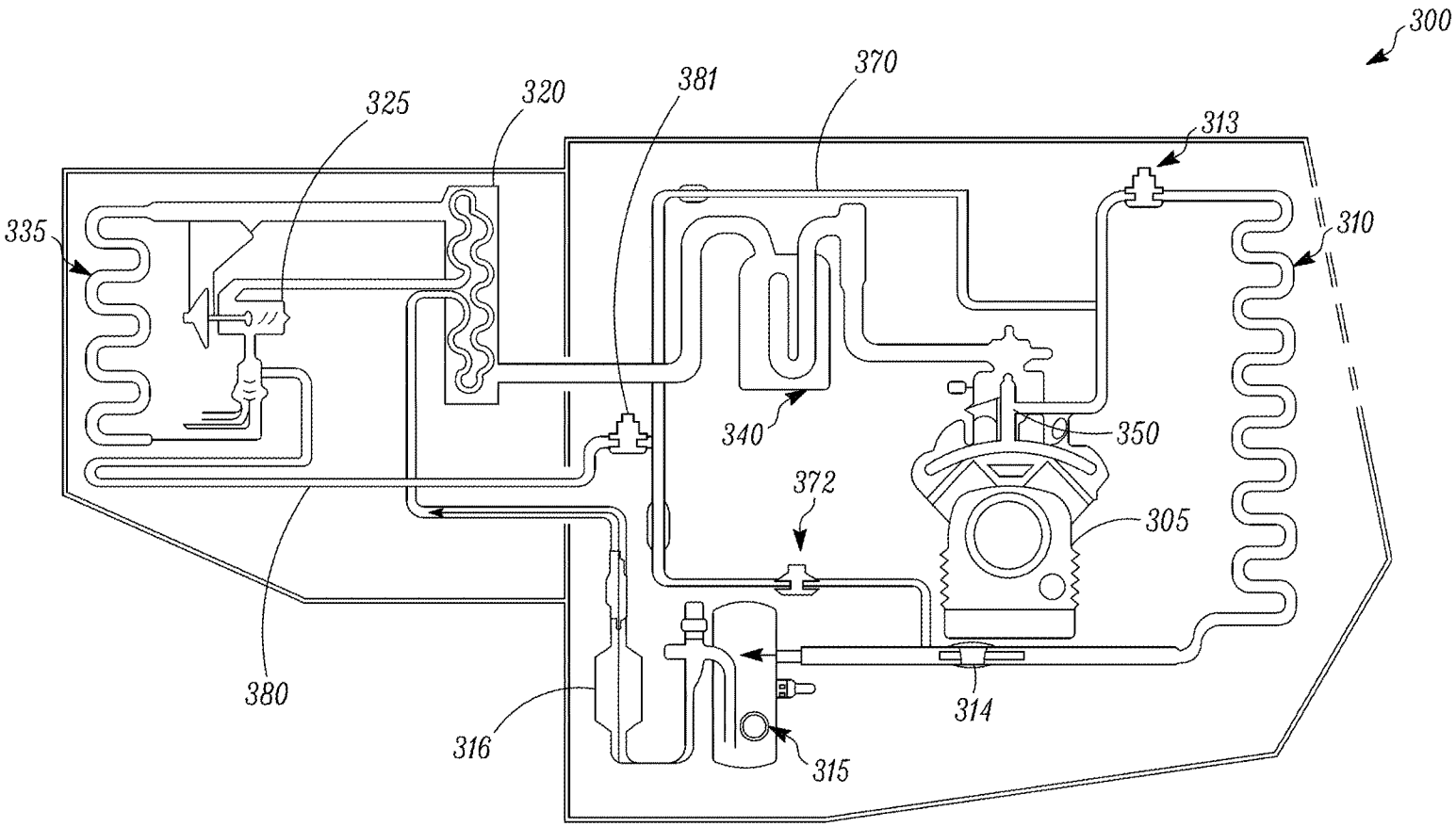
FIG. 3 illustrates a schematic diagram of a TRU according to a second embodiment.

FIG. 3 illustrates a TRU 300. A heating/defrost branch of the TRU 300 generally includes an evaporator coil 335, a heat exchanger 320 and an accumulator tank 340. A liquid refrigerant section may include a receiver tank 315, a dryer 316 and associated refrigerant lines.

In a refrigerant recovery operation, the condenser coil 310 is isolated from a discharge port 350 of the compressor 305 by closing a condenser inlet solenoid valve 313. Refrigerant out of the discharge port 350 can be directed into a bypass line 370.

The heating/defrost branch of the TRU 300 is isolated from the discharge port 350 of the compressor 305 by closing a hot gas solenoid valve 381 on a hot gas line 380. A bypass line solenoid valve 372 is open, allowing the refrigerant discharged from the discharge port 350 to enter a portion of the liquid refrigerant section (e.g. the receiver tank 315 and the dryer 316) and push the refrigerant in the liquid refrigerant section to the heating/defrost branch (e.g. the evaporator coil 335) of the TRU 300. A condenser outlet check valve 314 is configured to prevent refrigerant from flowing into the condenser coil 310 through the condenser outlet check valve 314. In the embodiment as shown in FIG. 3, the bypass line solenoid valve 372 is positioned between a connection position of the hot gas line 380 and the connection position of the liquid refrigerant section along the bypass line 370.

In the embodiment as illustrated in FIG. 3, the refrigerant out of the liquid refrigerant section can enter the heat exchanger 320, and may enter the evaporator coil 335 through an expansion device 325. Going through an expansion device, such as the expansion device 325, can sometime reduce a temperature of the refrigerant. A damper (not shown) of the TRU 300 can be closed to prevent air circulation between the evaporator coil 335 and, for example, indoor air of a transport unit, so that the temperature inside the transport unit may not be affected by the temperature change caused by pushing refrigerant through the expansion device 325.

After, for example, a predetermined period of time, the hot gas line solenoid 381 can be opened to allow hot refrigerant to flow from the discharge port 350 into the heating/defrost branch through the hot gas line 380. The TRU 300 ends the refrigerant recovery operation and enters the normal heating/defrost operation. The bypass line solenoid valve 372 can be closed in the normal heating/defrost operation to prevent refrigerant flowing into, for example, the receiver tank 315.

In general, FIG. 3 provides another embodiment that includes the bypass line 370 configured to direct discharge pressure from the compressor 305 to drive refrigerant trapped in at least a portion of the liquid refrigerant section into the heating/defrost branch. The recovered refrigerant is mainly driven to the heating/defrost branch through the heat exchanger 320 and the expansion device 325.

Figure 4:
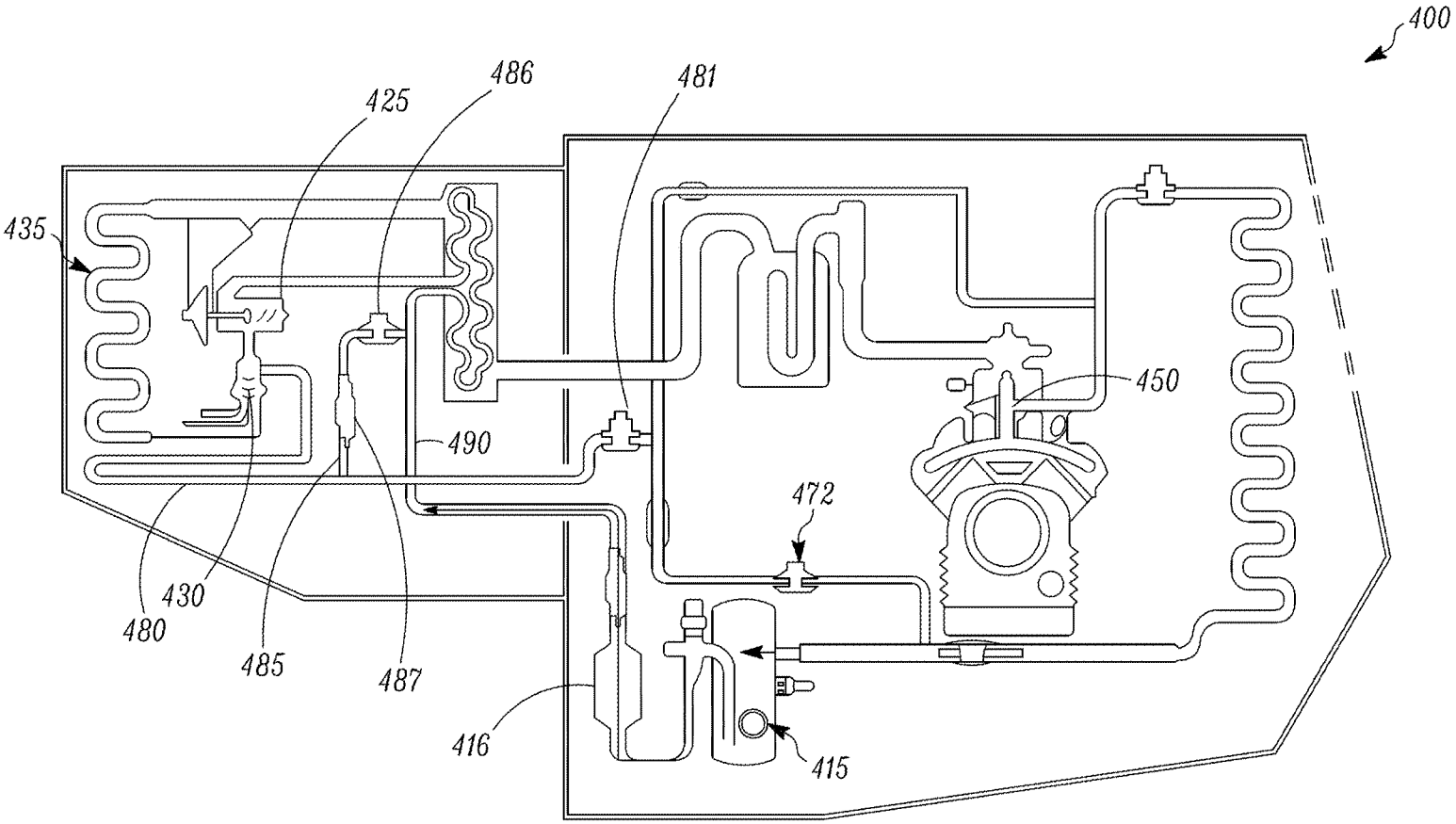
FIG. 4 further illustrates a schematic diagram of a TRU according to a third embodiment.
Figure 5:
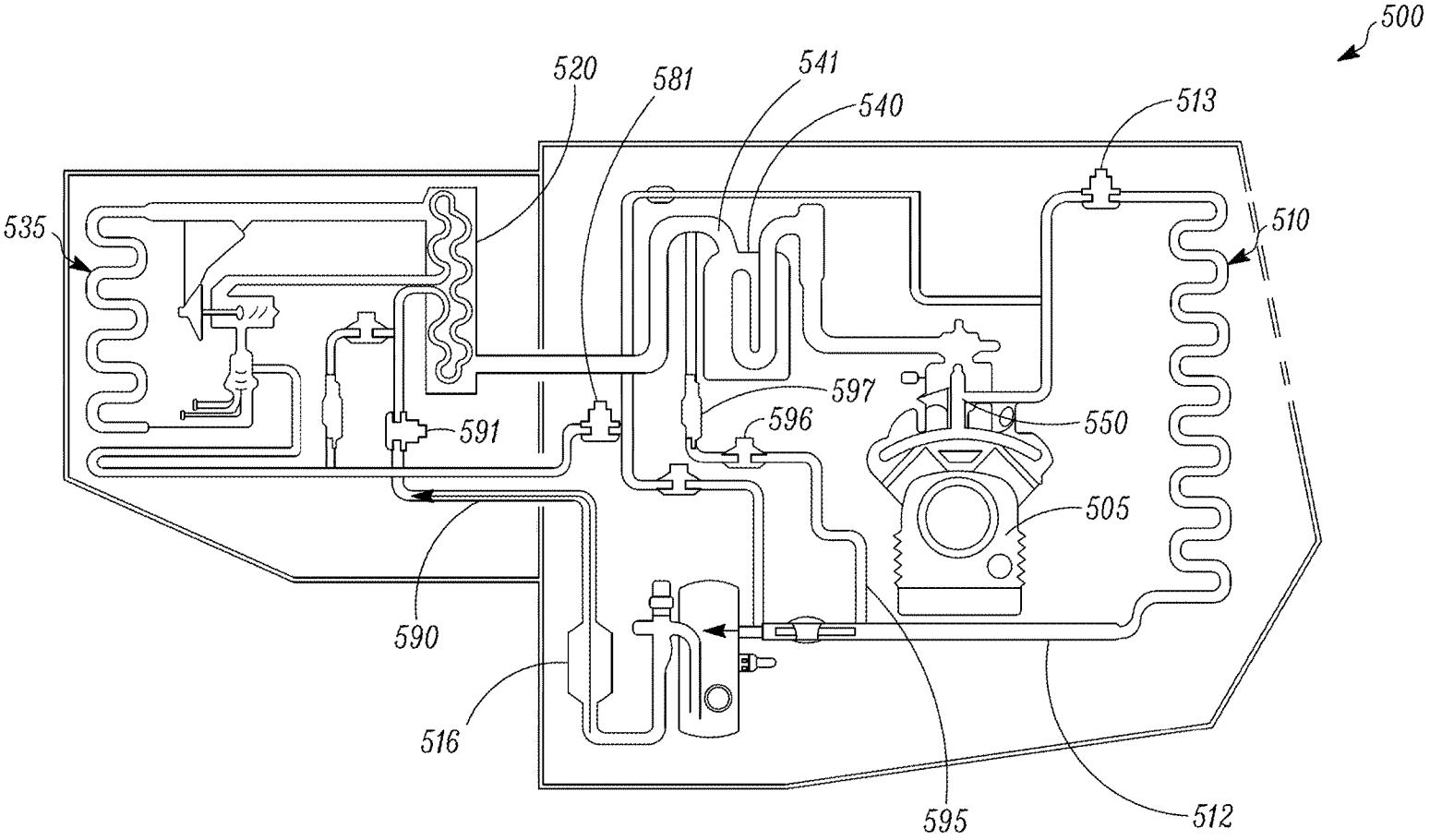
FIG. 5 illustrates a schematic diagram of a TRU according to a fourth embodiment.

FIG. 4 illustrates another TRU 400 that is largely similar to the TRU 300 as illustrated in FIG. 3. However, a liquid to hot gas line 485 is configured to connect a liquid line 490 to a hot gas line 480. The liquid to hot gas line 485 is equipped with a liquid to hot gas line solenoid valve 486 and a check valve 487 to prevent refrigerant from flowing from the hot gas line 480 toward the liquid line 490.

In a refrigerant recovery operation after the TRU activates a heating/defrost mode or switches from a cooling mode to the heating/defrost mode, the liquid to hot gas line solenoid valve 486 is open, a hot gas line solenoid valve 481 is closed and a bypass line solenoid valve 472 is open. The refrigerant out of a discharge port 450 is directed into a receiver tank 415 and a dryer 416 through the bypass line solenoid valve 472 and push refrigerant out of the receiver tank 415 and the dryer 416 (i.e. a liquid refrigerant section).

Because the liquid to hot gas line solenoid valve 486 is open, the refrigerant can then be directed into the hot gas line 480 and an evaporator coil 435 through a distributor 430. The liquid to hot gas line 485 allows the refrigerant to get into a heating/defrost branch of the TRU 400 without flowing through an expansion device 425, which helps maintain the temperature of the refrigerant relative to, for example, the TRU 300 as illustrated in FIG. 3.

In general, FIG. 4 provides another embodiment that is configured to direct discharge pressure to drive refrigerant trapped in at least a portion of the liquid refrigerant section into the heating/defrost branch. The recovered refrigerant is mainly driven to the heating/defrost branch through the distributor 430.

In the embodiments as illustrated in FIGS. 1, 3 and 4, the condenser coil is generally isolated from the discharge port of the compressor in the refrigerant recovery operation. The refrigerant that may be trapped in the condenser coil is generally prevented from being driven out in the refrigerant recovery operation.

FIG. 5 illustrates another TRU 500 that includes a condenser evacuation operation that is configured to recover the refrigerant from the condenser coil when the TRU 500 starts in a heating/defrost mode or switches from a cooling mode to the heating/defrost mode.

The TRU 500 is largely similar to the TRU 400 as illustrated in FIG. 4 except for the addition of a liquid line solenoid valve 591 that is positioned between a dryer 516 and a heat exchanger 520 along a liquid line 590, and a condenser evacuation line 595 and a condenser evacuation line solenoid valve 596 that are configured to connect a condenser outlet 512 of an condenser coil 510 to the heating/defrost branch of the TRU 500.

In the embodiment as illustrated in FIG. 5, the condenser evacuation line 595 is connected to an inlet 541 of an accumulator tank 540. It is to be understood that the condenser evacuation line 595 may be connected to other positions of the heating/defrost branch of the TRU 500, which may include an evaporator coil 535, the accumulator tank 540, and the associated refrigerant lines. In the illustrated embodiment, the condenser evacuation line 595 also includes a condenser evacuation line check valve 597 that is configured to prevent refrigerant from flowing back to the condenser coil 510 along the condenser evacuation line 595.

In the condenser evacuation operation, the liquid line solenoid valve 591 and a hot gas line solenoid valve 581 are closed. The condenser evacuation line solenoid valve 596 is open. A condenser inlet solenoid valve 513 is open to allow discharge refrigerant from a discharge port 550 of a compressor 505 to push refrigerant trapped in the condenser coil 510 to the heating/defrost branch of the TRU 500 including the accumulator tank 540. After a predetermined period of time, for example, the condenser evacuation solenoid, valve 596 may be closed and the liquid line solenoid valve 591 may be open so that the TRU 500 may enter a refrigerant recovery operation similar to what is disclosed in FIGS. 2 and 4, in which the discharge refrigerant from the discharge port 550 of the compressor 505 may be used to drive refrigerant trapped in the liquid line to the heating/defrost branch.

It is to be appreciated that the condenser evacuation line 595 and the condenser evacuation solenoid valve 596 that are configured to recover refrigerant trapped in the condenser coil 510 can be used with other embodiments of refrigerant recovery, such as illustrated in FIGS. 1 and 3.

It is to be noted that the condenser evacuation operation can also be added as part of the method 200 as illustrated in FIG. 2. For example, as illustrated in FIG. 2, the condenser evacuation operation can be optionally added as 270 between 210 and 220.

It is to be appreciated that the embodiments as disclosed herein are not limited to TRU, and may be used with other refrigeration systems that are configured to work in a cooling mode and a heating/defrost mode.

Aspects

Any of aspects 1-9 can be combined with any of aspects 10-15. Any aspects 10-14 can be combined with aspect 15.

Aspect 1. A transport refrigeration unit, comprising:

a compressor including a suction port and a discharge port;

a condenser coil including a condenser inlet and a condenser outlet, the condenser inlet connected to the discharge port through a condenser inlet solenoid valve and the condenser outlet equipped with a condenser outlet check valve configured to prevent refrigerant flowing back to the condenser coil through the condenser outlet check valve;

a liquid refrigerant section connected to the condenser outlet of the condenser coil; and a bypass line connecting the discharge port to the liquid refrigerant section, the bypass line including a bypass line solenoid valve;

wherein when the transport refrigeration unit is in a refrigerant recovery operation in a heating/defrost mode, the condenser inlet solenoid valve is configured to be in a closed state, and the bypass line solenoid valve is configured to be in an open state so as to direct refrigerant discharged from the discharge port to the liquid refrigerant section.

Aspect 2. The transport refrigeration unit of aspect 1 further comprising:

a hot gas line connecting the bypass line to a heating/defrost branch, the hot gas line including a hot gas line solenoid valve, wherein the hot gas line solenoid valve is configured to be in a closed state when the transport refrigerant unit is in the refrigerant recovery operation in the heating/defrost mode, and the hot gas line solenoid valve is configured to be in an open state when the transport refrigerant unit is operated in a normal heating/defrost operation in the heating/defrost mode.

Aspect 3. The transport refrigeration unit of aspects 1-3 further comprising:

a liquid to hot gas line connecting the liquid line to the hot gas line, the liquid to hot gas line including a liquid to hot gas line solenoid valve;

wherein when the transport refrigeration unit is in the refrigerant recovery operation in the heating/defrost mode, the liquid to hot gas line solenoid valve is configured to be in an open state so as to allow refrigerant from the liquid refrigerant section to flow to the evaporator coil through the liquid to hot gas line.

Aspect 4. The transport refrigeration unit of aspect 3, further comprising:

a check valve on the liquid to hot gas line configured to prevent refrigerant from flowing from the hot gas line to the liquid line.

Aspect 5. The transport refrigeration unit of aspects 1-4 further comprising:

a condenser evacuation line connecting the condenser outlet of the condenser coil to a heating/defrost branch of the transport refrigeration unit, the condenser evacuation line including a condenser evacuation solenoid valve;

wherein the condenser evacuation solenoid valve is configured to be in an open state when the transport refrigeration unit is in a condenser evacuation operation of the heating/defrost mode, and the condenser evacuation solenoid valve is configured to be in a close state when the transport refrigerant unit is in a normal heating/defrost operation of the heating/defrost mode.

Aspect 6. The transport refrigeration unit of aspects 1-5, wherein the liquid refrigerant section includes a receiver tank.

Aspect 7. The transport refrigeration unit of aspects 1-6, wherein the liquid refrigerant section includes a dryer.

Aspect 8. The transport refrigeration unit of aspects 5-7, wherein the heating/defrost branch of the transport refrigeration unit includes an evaporator coil.

Aspect 9. The transport refrigeration unit of aspects 5-8, wherein the heating/defrost branch of the transport refrigeration unit includes an accumulator tank.

Aspect 10. A method to recover refrigerant for use in a heating/defrost mode of a transport refrigeration unit, comprising;

isolating a condenser coil from a discharge port of a compressor of the transport refrigeration unit;

isolating a heating/defrost branch of the transport refrigeration unit from the discharge port of the condenser coil;

directing refrigerant to flow from the discharge port of the compressor to a liquid refrigerant section of the transport refrigeration unit while isolating the condenser coil from the discharge port of the compressor of the transport refrigerant unit and isolating the heating/defrost branch of the transport refrigeration unit from the discharge port of the condenser coil; and when a predetermined time has reached, connecting the discharge port of the compressor to the heating/defrost branch of the transport refrigeration unit.

Aspect 11. The method of aspect 10, wherein the liquid refrigerant section includes a receiver tank.

Aspect 12. The method of aspects 10-11, wherein the liquid refrigerant section includes a dryer.

Aspect 13. The method of aspects 10-12, wherein the heating/defrost branch of the transport refrigeration unit includes an evaporator coil.

Aspect 14. The method of aspects 10-13, wherein the heating/defrost branch of the transport refrigeration unit includes an accumulator tank.

Aspect 15. The method to recover refrigerant for use in a heating/defrost mode of a transport refrigeration unit of aspects 10-14, further comprising:

isolating the discharge port of the compressor from the liquid refrigerant section of the transport refrigeration unit; and allowing refrigerant to flow from the discharge port of the compressor to the condenser coil of the transport refrigeration unit.

Aspect 16. The method of aspects 10-15, further comprising:

operating the transport refrigeration unit in a heating/defrost mode so as to provide heat to an indoor space of a transport unit.

With regard to the foregoing description, it is to be understood that changes may be made in detail, without departing from the scope of the present invention. It is intended that the specification and depicted embodiments are to be considered exemplary only, with a true scope and spirit of the invention being indicated by the broad meaning of the claims.

The invention claimed is:

1. A transport refrigeration unit, comprising:

a compressor including a suction port and a discharge port;

a condenser coil including a condenser inlet and a condenser outlet, the condenser inlet connected to the discharge port through a condenser inlet solenoid valve and the condenser outlet equipped with a condenser outlet check valve configured to prevent refrigerant flowing back to the condenser coil through the condenser outlet check valve;

a liquid refrigerant section connected to the condenser outlet of the condenser coil;

a bypass line connecting the discharge port to the liquid refrigerant section, the bypass line including a bypass line solenoid valve;

a hot gas line connecting the bypass line to a heating/defrost branch, the hot gas line including a hot gas line solenoid valve;

wherein when the transport refrigeration unit is in a refrigerant recovery operation in a heating/defrost mode, the condenser inlet solenoid valve is configured to be in a closed state, the bypass line solenoid valve is configured to be in an open state, and the hot gas line solenoid valve is configured to be in a closed state so as to direct refrigerant discharged from the discharge port to the liquid refrigerant section and prevent the refrigerant discharged from the discharge port from flowing into the hot gas line and through an evaporator coil via the hot gas line.

2. The transport refrigeration unit of claim 1, further comprising:

wherein the hot gas line solenoid valve is configured to be in an open state when the transport refrigerant unit is operated in a normal heating/defrost operation in the heating/defrost mode.

3. The transport refrigeration unit of claim 1, further comprising:

a liquid to hot gas line connecting a liquid line to the hot gas line, the liquid to hot gas line including a liquid to hot gas line solenoid valve;

wherein when the transport refrigeration unit is in the refrigerant recovery operation in the heating/defrost mode, the liquid to hot gas line solenoid valve is configured to be in an open state so as to allow refrigerant from the liquid refrigerant section to flow to the evaporator coil through the liquid to hot gas line.

4. The transport refrigeration unit of claim 3, further comprising:

a check valve on the liquid to hot gas line configured to prevent refrigerant from flowing from the hot gas line to the liquid line.

5. The transport refrigeration unit of claim 1, further comprising:

a condenser evacuation line connecting the condenser outlet of the condenser coil to a heating/defrost branch of the transport refrigeration unit, the condenser evacuation line including a condenser evacuation solenoid valve;

wherein the condenser evacuation solenoid valve is configured to be in an open state when the transport refrigeration unit is in a condenser evacuation operation of the heating/defrost mode, and the condenser evacuation solenoid valve is configured to be in a close state when the transport refrigerant unit is in a normal heating/defrost operation of the heating/defrost mode.

6. The transport refrigeration unit of claim 5, wherein the heating/defrost branch of the transport refrigeration unit includes the evaporator coil.

7. The transport refrigeration unit of claim 5, wherein the heating/defrost branch of the transport refrigeration unit includes an accumulator tank.

8. The transport refrigeration unit of claim 1, wherein the liquid refrigerant section includes a receiver tank.

9. The transport refrigeration unit of claim 1, wherein the liquid refrigerant section includes a dryer.

10. The transport refrigeration unit of claim 1, wherein when the transport refrigeration unit is in a heating/defrost operation in the heating/defrost mode, the condenser inlet solenoid valve is configured to be in a closed state, the bypass line solenoid valve is configured to be in an open state, and the hot gas line solenoid valve is configured to be in an open state so as to direct refrigerant discharged from the discharge port to the liquid refrigerant section and then through the hot gas line to the heating/defrost branch including the evaporator coil.

11. The method of claim 10, further comprising:

after a predetermined period of time, switching the heating/defrost mode from the refrigerant recovery operation to the heating/defrost operation.

12. The method of claim 10, further comprising:

switching the heating/defrost mode from the refrigerant recovery operation to the heating/defrost operation when a discharge pressure from the discharge port of the compressor reaches a predetermined pressure.

13. A method to recover refrigerant for use in a heating/defrost mode of a transport refrigeration unit, comprising:

during a refrigerant recovery operation of the heating/defrost mode, isolating a condenser coil from a discharge port of a compressor of the transport refrigeration unit by closing a condenser inlet solenoid valve that directs refrigerant from the discharge port to the condenser coil when open;

during the refrigerant recovery operation of the heating/defrost mode, isolating a heating/defrost branch of the transport refrigeration unit from a discharge port of the condenser coil by closing a hot gas line solenoid valve that directs refrigerant, via a hot gas line, from the discharge port to a heating/defrost branch including an evaporator coil when open; and during the refrigerant recovery operation of the heating/defrost mode, directing refrigerant to flow from the discharge port of the compressor to a liquid refrigerant section of the transport refrigeration unit via a bypass line while preventing the refrigerant from flowing from the discharge port of the compressor to the condenser coil and preventing the refrigerant from flowing from the discharge port of the compressor to the heating/defrost branch including through the evaporator coil via the hot gas line.

14. The method of claim 13, wherein the liquid refrigerant section includes a receiver tank.

15. The method of claim 13, wherein the liquid refrigerant section includes a dryer.

16. The method of claim 13, wherein the heating/defrost branch of the transport refrigeration unit includes an accumulator tank.

17. The method of claim 13, further comprising:

isolating the discharge port of the compressor from the liquid refrigerant section of the transport refrigeration unit; and allowing refrigerant to flow from the discharge port of the compressor to the condenser coil of the transport refrigeration unit.

18. The method of claim 13, further comprising:

operating the transport refrigeration unit in the heating/defrost mode so as to provide heat to an indoor space of a transport unit.

19. The method of claim 13, further comprising:

during a heating/defrost operation in the heating/defrost mode, connecting the discharge port of the compressor to the heating/defrost branch of the transport refrigeration unit by opening the hot gas line solenoid valve to direct refrigerant from the discharge port of the compressor to the heating/defrost branch via the hot gas line.

20. A transport refrigeration unit, comprising:

a compressor including a suction port and a discharge port;

a condenser coil including a condenser inlet and a condenser outlet, the condenser inlet connected to the discharge port through a condenser inlet solenoid valve and the condenser outlet equipped with a condenser outlet check valve configured to prevent refrigerant flowing back to the condenser coil through the condenser outlet check valve;

a liquid refrigerant section connected to the condenser outlet of the condenser coil;

a bypass line connecting the discharge port to the liquid refrigerant section, the bypass line including a bypass line solenoid valve;

a liquid to hot gas line connecting a liquid line to a hot gas line, the liquid to hot gas line including a liquid to hot gas line solenoid valve; and a check valve on the liquid to hot gas line configured to prevent refrigerant from flowing from the hot gas line to the liquid line;

wherein when the transport refrigeration unit is in a refrigerant recovery operation in a heating/defrost mode, the condenser inlet solenoid valve is configured to be in a closed state, and the bypass line solenoid valve is configured to be in an open state so as to direct refrigerant discharged from the discharge port to the liquid refrigerant section, wherein when the transport refrigeration unit is in the refrigerant recovery operation in the heating/defrost mode, the liquid to hot gas line solenoid valve is configured to be in an open state so as to allow refrigerant from the liquid refrigerant section to flow to an evaporator coil through the liquid to hot gas line.

* * * * *